US011501748B2

(12) United States Patent
Tachi

(10) Patent No.: US 11,501,748 B2
(45) Date of Patent: Nov. 15, 2022

(54) ACTIVE NOISE CONTROL SYSTEM

(71) Applicant: ALPINE ELECTRONICS, INC., Tokyo (JP)

(72) Inventor: Ryosuke Tachi, Iwaki (JP)

(73) Assignee: ALPINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 16/880,170

(22) Filed: May 21, 2020

(65) Prior Publication Data

US 2020/0372893 A1 Nov. 26, 2020

(30) Foreign Application Priority Data

May 22, 2019 (JP) ..... JP2019-096400

(51) Int. Cl.
*G10K 11/178* (2006.01)
*H04R 1/10* (2006.01)

(52) U.S. Cl.
CPC .. *G10K 11/17857* (2018.01); *G10K 11/17821* (2018.01); *G10K 11/17873* (2018.01); *H04R 1/1083* (2013.01); *G10K 2210/102* (2013.01); *G10K 2210/1081* (2013.01); *G10K 2210/3019* (2013.01)

(58) Field of Classification Search
CPC ..... H04R 2499/13; H04R 1/1083; H04R 2460/01; H04R 2410/01; H04R 29/00; G10K 11/178; G10K 11/17854; G10K 2210/1282; G10K 2210/1081; G10K 11/17873; G10K 2210/3221; G10K 11/17857; G10K 2210/128; G10K 11/17821; G10K 2210/102; G10K 2210/3019
USPC .... 381/71.4, 86, 71.1, 71.11, 71.6, 71.8, 92, 381/122, 56, 365, 58, 13, 302, 389, 97; 181/206; 455/569.2, 296, 570
See application file for complete search history.

(56) References Cited

U.S. PATENT DOCUMENTS 5,377,276 A * 12/1994 Terai ..... G10K 11/1785 381/71.11
9,020,158 B2 * 4/2015 Wertz ..... G10K 11/17854 381/71.11

(Continued)

FOREIGN PATENT DOCUMENTS

DE WO 2019/024985 * 2/2019
JP 2018-072770 5/2018

*Primary Examiner* — Norman Yu
(74) *Attorney, Agent, or Firm* — Crowell & Moring LLP

(57) ABSTRACT

A first cancellation signal output from a first speaker cancels noise at a first cancellation point, which is a typical position of the right ear of a user, together with a second cancellation signal output from a second speaker. In addition, the second cancellation signal output from the second speaker cancels noise at a second cancellation point, which is a typical position of the left ear of the user, together with the first cancellation signal output from the first speaker. The first speaker and the second speaker are arranged side by side on a second line segment, which passes through the midpoint of a first line segment connecting the first cancellation point and the second cancellation point to each other and is perpendicular to the first line segment, and a range where the relationship between noise and the first cancellation signal and the second cancellation signal is the same as that at the cancellation point is extended.

14 Claims, 5 Drawing Sheets

(56) References Cited

U.S. PATENT DOCUMENTS

| | | | | |
|---|---|---|---|---|
| 10,440,480 | B2 * | 10/2019 | Butts | H04R 3/12 |
| 2008/0317254 | A1 * | 12/2008 | Kano | G10K 11/17881 381/71.4 |
| 2010/0290635 | A1 * | 11/2010 | Shridhar | G10K 11/17881 381/71.1 |
| 2019/0355339 | A1 * | 11/2019 | Seffernick | B60N 2/803 |

* cited by examiner

FIG. 2A1
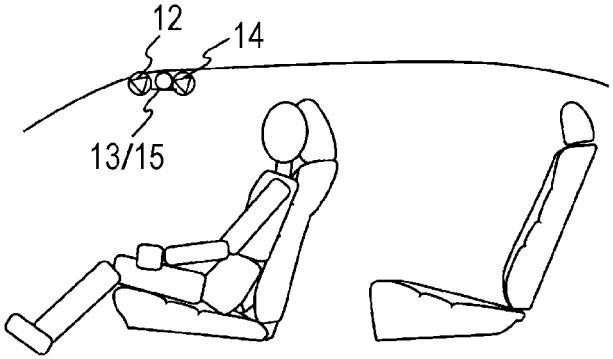
FIG. 2A2
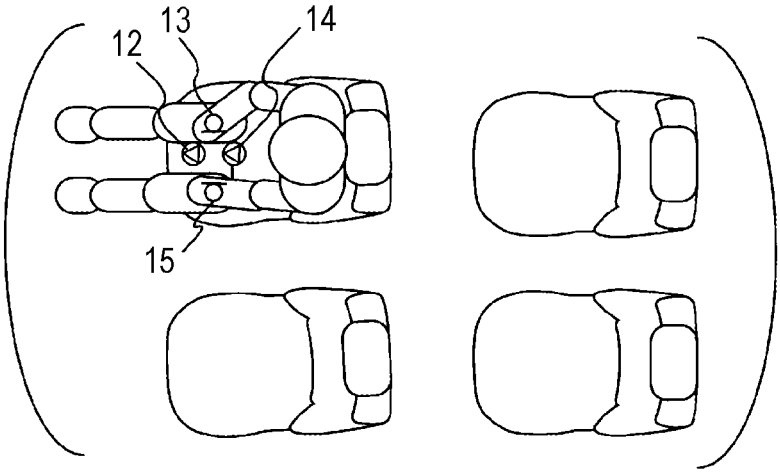

ACTIVE NOISE CONTROL SYSTEM

RELATED APPLICATION

The present application claims priority to Japanese Patent Application Number 2019-096400, filed May 22, 2019, the entirety of which is hereby incorporated by reference.

BACKGROUND

1. Field of the Invention

The present invention relates to a technique of active noise control (ANC) for reducing noise by radiating a noise cancellation sound to cancel noise.

2. Description of the Related Art

As an active noise control technique for reducing noise by radiating a noise cancellation sound to cancel noise, a technique is known in which a microphone and a speaker arranged near a noise cancellation position and an adaptive filter, which generates a noise cancellation sound output from the speaker by applying a transfer function adaptively set to an output signal of a noise source or a signal simulating the output signal, are provided and the transfer function is adaptively set as an error signal obtained by correcting the output of the microphone using an auxiliary filter in the adaptive filter.

In this technique, transfer functions for correcting the difference between a transfer function from the noise source to the noise cancellation position and a transfer function from the noise source to the microphone and the difference between a transfer function from the speaker to the noise cancellation position and a transfer function from the speaker to the microphone, which are learned in advance, are set in the auxiliary filter. By using such an auxiliary filter, noise is canceled at a noise cancellation position different from the position of the microphone.

In addition, a technique is also known in which a set of a microphone, a speaker, an adaptive filter, and an auxiliary filter corresponding to each of two noise cancellation positions is provided and a noise cancellation sound to cancel noise at the corresponding noise cancellation position in each set is output using the technique described above, so that the noise generated from a noise source is canceled at each of the two noise cancellation positions (for example, JP 2018-72770 A).

In order to cancel the noise heard by a user sitting in a seat, when the standard positions of the right ear and the left ear of the user sitting in the seat are set to two noise cancellation positions and the noise generated from the noise source is canceled at each of the two noise cancellation positions by the technique described above, if the right ear and the left ear of the user are shifted from the noise cancellation positions due to the displacement of the user due to the movement of the seat or the movement of the user sitting in the seat, the noise heard by the user may not be canceled satisfactorily.

SUMMARY

Therefore, it is an object of the present disclosure to provide an active noise control system for canceling noise heard by a user without being easily affected by the displacement of the user.

In order to achieve the aforementioned object, according to the present disclosure, an active noise control system for reducing noise includes: a first speaker configured to output a first cancellation sound; a second speaker configured to output a second cancellation sound; and a cancellation sound generation unit that generates the first cancellation sound output from the first speaker and the second cancellation sound output from the second speaker such that noise is canceled at a first cancellation point set in advance and noise is canceled at a second cancellation point set in advance. The first speaker and the second speaker are arranged side by side in a direction perpendicular to a line segment connecting the first cancellation point and the second cancellation point to each other such that positions of the first speaker and the second speaker in a direction of the line segment are located between the first cancellation point and the second cancellation point.

Here, in such an active noise control system, it is preferable that the first speaker and the second speaker are arranged side by side in the direction perpendicular to the line segment connecting the first cancellation point and the second cancellation point to each other such that the positions of the first speaker and the second speaker in the direction of the line segment are the same as a midpoint of the first cancellation point and the second cancellation point.

In the active noise control system described above, the first cancellation point and the second cancellation point may be a point where a left ear of a person sitting in a predetermined seat is normally located and a point where a right ear of the user is normally located, respectively.

In addition, in this case, the predetermined seat may be a seat of a vehicle, and the first speaker and the second speaker may be arranged side by side in a front-rear direction of the vehicle on a ceiling in front of the seat of the vehicle.

In the active noise control system described above, the cancellation sound generation unit may include a first microphone, a second microphone, a first adaptive filter configured to receive a noise signal indicating the noise and generate the first cancellation sound, and a second adaptive filter configured to receive a noise signal indicating the noise and generate the second cancellation sound. Here, the first adaptive filter and the second adaptive filter adapt their own transfer functions as the first cancellation sound output from the first speaker and the second cancellation sound output from the second speaker, using an input sound from each of the first microphone and the second microphone, so that noise is canceled at the first cancellation point and noise is canceled at the second cancellation point.

In this case, the cancellation sound generation unit may include a first auxiliary filter and a second auxiliary filter, and the first adaptive filter and the second adaptive filter may be configured to update their own transfer functions using a predetermined adaptive algorithm with a difference between the input sound from the first microphone and an output of the first auxiliary filter and a difference between the input sound from the second microphone and an output of the second auxiliary filter as errors. When a transfer function in which noise is canceled at the first cancellation point and the second cancellation point is set in the first adaptive filter and the second adaptive filter, a transfer function learned as a transfer function that eliminates the difference between the input sound from the first microphone and the output of the first auxiliary filter and the difference between the input sound from the second microphone and the output of the second auxiliary filter may be set in the first auxiliary filter and the second auxiliary filter.

According to the active noise control system described above, a range near the first cancellation point at which the phase (distance) of the first cancellation sound output from the first speaker and the phase (distance) of the second cancellation sound output from the second speaker are the same as those at the first cancellation point, and a range near the second cancellation point at which the phase of the first cancellation sound output from the first speaker and the phase of the second cancellation sound output from the second speaker are the same as those at the second cancellation point, can be set to be a relatively wide range. Therefore, it is possible to realize noise cancellation that is not easily affected by the displacement of the user.

As described above, according to the present disclosure, it is possible to provide the active noise control system for canceling the noise heard by the user without being easily affected by the displacement of the user.

BRIEF DESCRIPTION OF THE DRAWINGS

FIGS. 2A1 and 2A2 are diagrams illustrating an arrangement of speakers and microphones in the active noise control system according to the embodiment of the present invention;

DETAILED DESCRIPTION OF THE PREFERRED EMBODIMENTS

Figure 1:
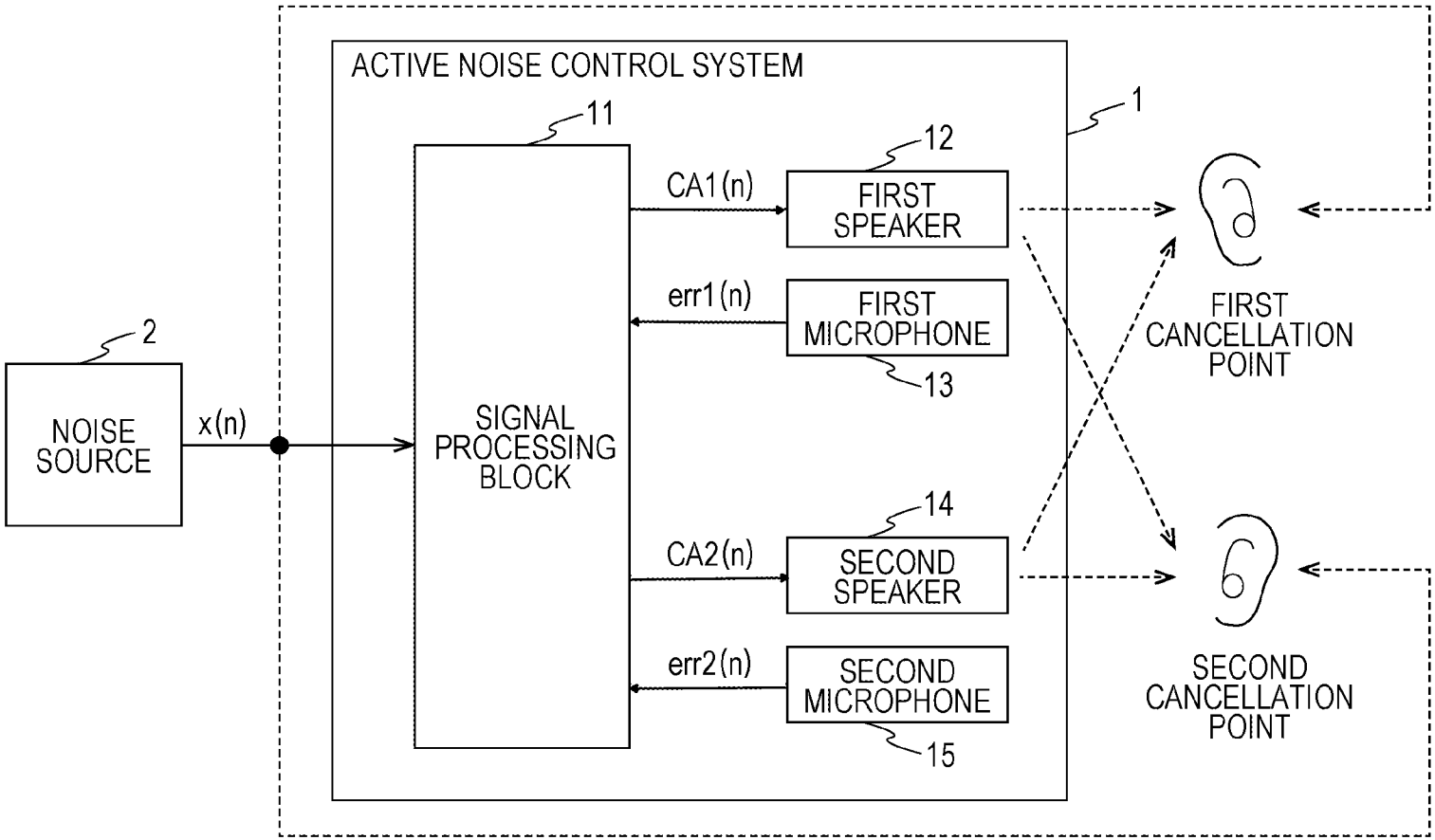
FIG. 1 is a block diagram illustrating the configuration of an active noise control system according to an embodiment of the present invention.

Hereinafter, an embodiment of the present invention will be described. FIG. 1 illustrates the configuration of an active noise control system according to the present embodiment. As illustrated in FIG. 1, an active noise control system 1 includes a signal processing block 11, a first speaker 12, a first microphone 13, a second speaker 14, and a second microphone 15. The active noise control system 1 may be a system installed in a vehicle, and is a system for canceling noise generated by a noise source 2 at each of two cancellation points of a first cancellation point, which is the position of the right ear of the user seated in a predetermined seat in the vehicle, and a second cancellation point, which is the position of the left ear of the user.

As illustrated in FIGS. 2A1 and 2A2, the first speaker 12 and the second speaker 14 are arranged side by side in the front-rear direction of the vehicle on the ceiling in front of a noise cancellation target seat that is a seat (right front seat in the diagram) where the user sits and which is a target of noise cancellation in the vehicle. In addition, the first speaker 12 and the second speaker 14 are arranged such that the positions of the first speaker 12 and the second speaker 14 in the right-left direction of the vehicle match the position of the center of the noise cancellation target seat in the right-left direction. In other words, in the present embodiment, the first speaker 12 and the second speaker 14 are arranged side by side in a direction (front-rear direction of the vehicle) perpendicular to a line segment connecting the first cancellation point and the second cancellation point to each other such that the positions of the first speaker 12 and the second speaker 14 in the line segment direction (right-left direction of the vehicle) are the same as the midpoint of the first cancellation point and the second cancellation point.

In addition, as illustrated in FIGS. 2A1 and 2A2, the first microphone 13 is arranged, for example, on the ceiling in front of the typical position of the right ear of the user sitting in the noise cancellation target seat, and the second microphone 15 is arranged, for example, on the ceiling in front of the typical position of the left ear of the user sitting in the noise cancellation target seat.

Referring back to FIG. 1, using a noise signal x(n) indicating the noise generated by the noise source 2, a first microphone error signal err1(*n*) that is a voice signal picked up by the first microphone 13, and a second microphone error signal err2(*n*) that is a voice signal picked up by the second microphone 15, the signal processing block 11 of the active noise control system 1 generates a first cancellation signal CA1(*n*) and outputs the first cancellation signal CA1(*n*) from the first speaker 12, and generates a second cancellation signal CA2(*n*) and outputs the second cancellation signal CA2(*n*) from the second speaker 14.

The first cancellation signal CA1(*n*) output from the first speaker 12 cancels the noise generated by the noise source 2 at the first cancellation point together with the second cancellation signal CA2(*n*) output from the second speaker 14. In addition, the second cancellation signal CA2(*n*) output from the second speaker 14 cancels the noise generated by the noise source 2 at the second cancellation point together with the first cancellation signal CA1(*n*) output from the first speaker 12.

Figure 3:
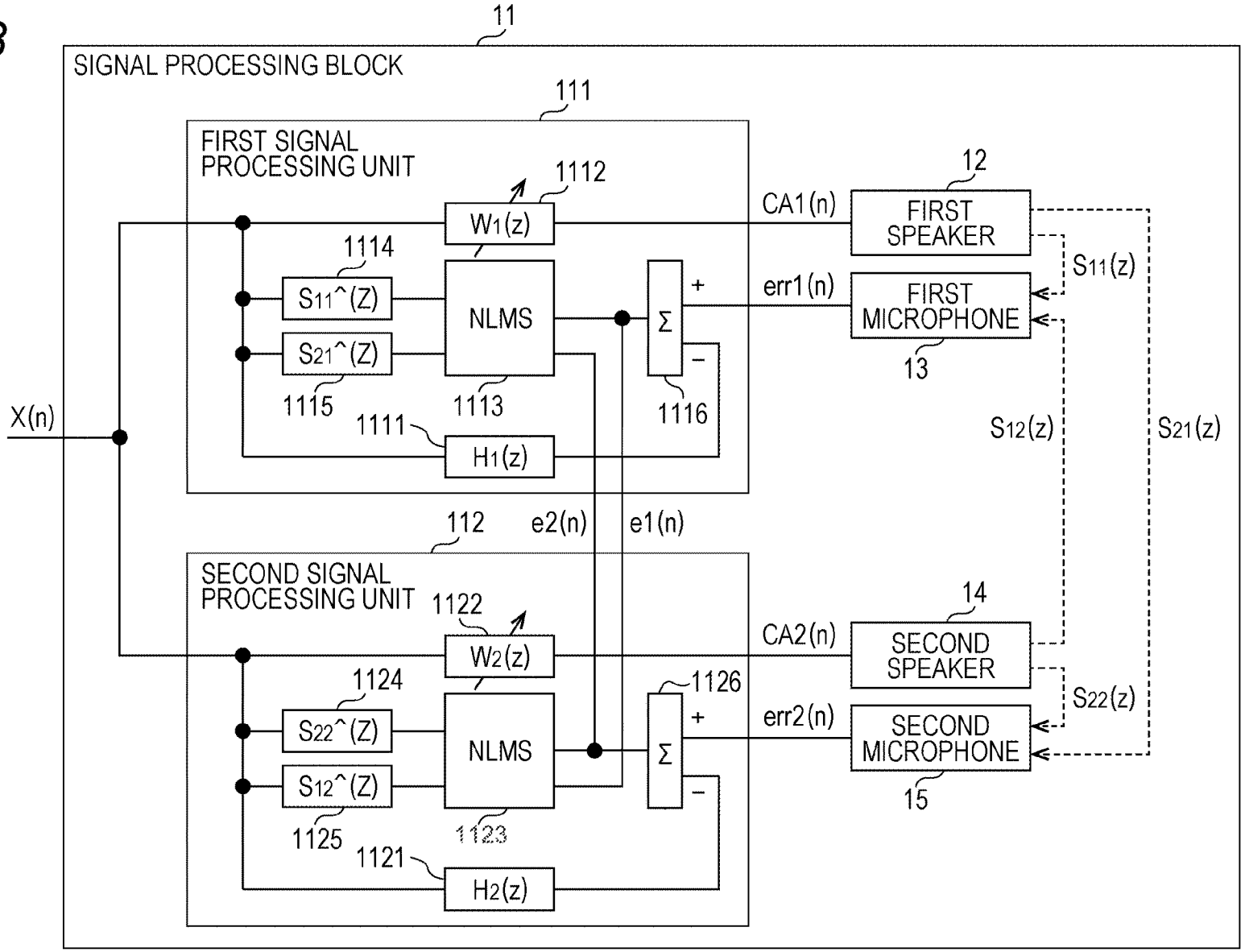
FIG. 3 is a block diagram illustrating the configuration of a signal processing block according to the embodiment of the present invention.

Next, FIG. 3 illustrates the configuration of the signal processing block 11 of the active noise control system 1. The signal processing block 11 includes a first signal processing unit 111 that mainly performs processing relevant to the generation of the first cancellation signal CA1(*n*) and a second signal processing unit 112 that mainly performs processing relevant to the generation of the second cancellation signal CA2(*n*).

As illustrated in FIG. 3, the first signal processing unit 111 includes a first system auxiliary filter 1111 in which a transfer function $H_1(z)$ is set in advance, a first system variable filter 1112, a first system adaptive algorithm execution unit 1113, a first system first estimation filter 1114 in which a transfer function $S_{11}\hat{}(z)$ is set in advance, a first system second estimation filter 1115 in which a transfer function $S_{21}\hat{}(z)$ is set in advance, and a first system subtractor 1116.

In such a configuration of the first signal processing unit 111, the input noise signal x(n) is output to the first speaker 12 as the first cancellation signal CA1(*n*) through the first system variable filter 1112.

In addition, the input noise signal x(n) is transmitted to the first system subtractor 1116 through the first system auxiliary filter 1111, and the first system subtractor 1116 subtracts the output of the first system auxiliary filter 1111 from the first microphone error signal err1(*n*) picked up by the first microphone 13 and outputs the result, as an error e1, to the first system adaptive algorithm execution unit 1113 and the second signal processing unit 112.

The first system variable filter 1112, the first system adaptive algorithm execution unit 1113, the first system first estimation filter 1114, and the first system second estimation filter 1115 form a multiple error filtered-X adaptive filter. In the first system first estimation filter 1114, an estimated transfer characteristic $S_{11}\hat{}(z)$ of a transfer function $S_{11}(z)$ from the first signal processing unit 111 to the first microphone 13 calculated by actual measurement or the like is set in advance. The first system first estimation filter 1114 convolves the input noise signal x(n) with the transfer characteristic $S_{11}\hat{}(z)$, and inputs the resultant signal to the first system adaptive algorithm execution unit 1113. In addition, in the first system second estimation filter 1115, an estimated transfer characteristic $S_{21}\hat{}(z)$ of a transfer characteristic $S_{21}(z)$ indicating a transfer function from the first signal processing unit 111 to the second microphone 15 calculated by actual measurement or the like is set in advance. The first system second estimation filter 1115 convolves the input noise signal x(n) with the transfer characteristic $S_{21}\hat{}(z)$, and inputs the resultant signal to the first system adaptive algorithm execution unit 1113.

Then, the first system adaptive algorithm execution unit 1113 receives the noise signal x(n) in which the transfer function $S_{11}\hat{}(z)$ is convoluted by the first system first estimation filter 1114, the noise signal x(n) in which the transfer function $S_{21}\hat{}(z)$ is convoluted by the first system second estimation filter 1115, the error e1 output from the first system subtractor 1116, and an error e2 output from the second signal processing unit 112, and executes an adaptive algorithm, such as NLMS, and updates a transfer function $W_1(z)$ of the first system variable filter 1112 so that the error e1 and the error e2 become 0.

The second signal processing unit 112 has the same configuration as the first signal processing unit 111, and the second signal processing unit 112 includes a second system auxiliary filter 1121 in which a transfer function $H_2(z)$ is set in advance, a second system variable filter 1122, a second system adaptive algorithm execution unit 1123, a second system first estimation filter 1124 in which a transfer function $S_{22}\hat{}(z)$ is set in advance, a second system second estimation filter 1125 in which a transfer function $S_{12}\hat{}(z)$ is set in advance, and a second system subtractor 1126.

In such a configuration of the second signal processing unit 112, the input noise signal x(n) is output to the second speaker 14 as the second cancellation signal CA2(*n*) through the second system variable filter 1122.

In addition, the input noise signal x(n) is transmitted to the second system subtractor 1126 through the second system auxiliary filter 1121, and the second system subtractor 1126 subtracts the output of the second system auxiliary filter 1121 from the second microphone error signal err2(*n*) picked up by the second microphone 15 and outputs the result, as an error e2, to the second system adaptive algorithm execution unit 1123 and the first signal processing unit 111.

The second system variable filter 1122, the second system adaptive algorithm execution unit 1123, the second system first estimation filter 1124, and the second system second estimation filter 1125 form a multiple error filtered-X adaptive filter. In the second system first estimation filter 1124, an estimated transfer characteristic $S_{22}\hat{}(z)$ of a transfer function $S_{22}(z)$ from the second signal processing unit 112 to the second microphone 15 calculated by actual measurement or the like is set in advance. The second system first estimation filter 1124 convolves the input noise signal x(n) with the transfer characteristic $S_{22}\hat{}(z)$, and inputs the resultant signal to the second system adaptive algorithm execution unit 1123. In addition, in the second system second estimation filter 1125, an estimated transfer characteristic $S_{12}\hat{}(z)$ of a transfer characteristic $S_{12}(z)$ indicating a transfer function from the second signal processing unit 112 to the first microphone 13 calculated by actual measurement or the like is set in advance. The second system second estimation filter 1125 convolves the input noise signal x(n) with the transfer characteristic $S_{12}\hat{}(z)$, and inputs the resultant signal to the second system adaptive algorithm execution unit 1123.

The second system adaptive algorithm execution unit 1123 receives the noise signal x(n) in which the transfer function $S_{22}\hat{}(z)$ is convoluted by the second system first estimation filter 1124, the noise signal x(n) in which the transfer function $S_{12}\hat{}(z)$ is convoluted by the second system second estimation filter 1125, the error e2 output from the second system subtractor 1126, and the error e1 output from the first signal processing unit 111, executes an adaptive algorithm, such as NLMS, and updates a transfer function $W_2(z)$ of the second system variable filter 1122 so that the error e1 and the error e2 become 0.

The first system auxiliary filter 1111 of the first signal processing unit 111 is provided to correct the difference between the positions of the first microphone 13 and the first cancellation point and the first microphone error signal err1(*n*), and the second system auxiliary filter 1121 of the second signal processing unit 112 is provided to correct the difference between the positions of the second microphone 15 and the second cancellation point and the second microphone error signal err2(*n*). In addition, the transfer function $H_1(z)$ set in the first system auxiliary filter 1111 of the first signal processing unit 111 and the transfer function $H_2(z)$ set in the second system auxiliary filter 1121 of the second signal processing unit 112 are transfer functions set in advance by learning. As a transfer function in which noise is canceled at each of the first cancellation point and the second cancellation point and which is obtained by placing a microphone for learning at the first cancellation point and the second cancellation point under the environment at the time of learning, the transfer function $H_1(z)$ and the transfer function $H_2(z)$ are set in which the error e1 output from the first system subtractor 1116 and the error e2 output from the second system subtractor 1126 are 0 and which are obtained in a state in which the transfer functions of the first system variable filter 1112 and the second system variable filter 1122 are fixed. In addition, the transfer functions of the first system variable filter 1112 and the second system variable filter 1122 in which noise is canceled at each of the first cancellation point and the second cancellation point change from those under the environment at the time of learning due to a change in the environment. Reflecting this change in the transfer functions of the first system variable filter 1112 and the second system variable filter 1122 is the update of the transfer function by the adaptive algorithm, such as the above-described NLMS.

Incidentally, in a range near the first cancellation point, it can be considered that the noise propagates in the same manner as at the first cancellation point. Therefore, at a position within the range near the first cancellation point, at which the phase (distance) of the first cancellation signal CA1(*n*) output from the first speaker 12 and the phase (distance) of the second cancellation signal CA2(*n*) output from the second speaker 14 are the same as those at the first cancellation point, the relationship between the noise and the first cancellation signal CA1(*n*) and the second cancellation signal CA2(*n*) is the same as that at the first cancellation point. For this reason, the effect of noise cancellation can be expected.

Similarly, in a range near the second cancellation point, it can be considered that the noise propagates in the same manner as at the second cancellation point. Therefore, at a position within the range near the second cancellation point, at which the phase of the first cancellation signal CA1(*n*) output from the first speaker 12 and the phase of the second cancellation signal CA2(*n*) output from the second speaker 14 are the same as those at the second cancellation point, the relationship between the noise and the first cancellation signal CA1(*n*) and the second cancellation signal CA2(*n*) is the same as that at the second cancellation point. For this reason, the effect of noise cancellation can be expected.

In addition, as described above, in the present embodiment, the first speaker 12 and the second speaker 14 are arranged side by side in a direction (front-rear direction of the vehicle) perpendicular to the line segment connecting the first cancellation point and the second cancellation point to each other such that the positions of the first speaker 12 and the second speaker 14 in the line segment direction (right-left direction of the vehicle) are the same as the midpoint of the first cancellation point and the second cancellation point.

Figure 4B:
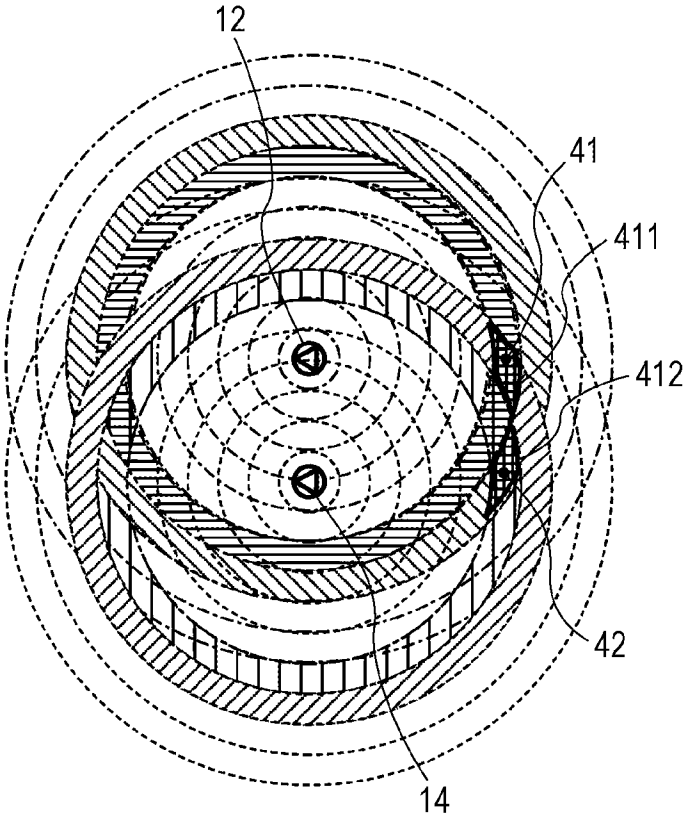
FIGS. 4A and 4B are diagrams illustrating an operation of the active noise control system according to the embodiment of the present invention.
Figure 4A:
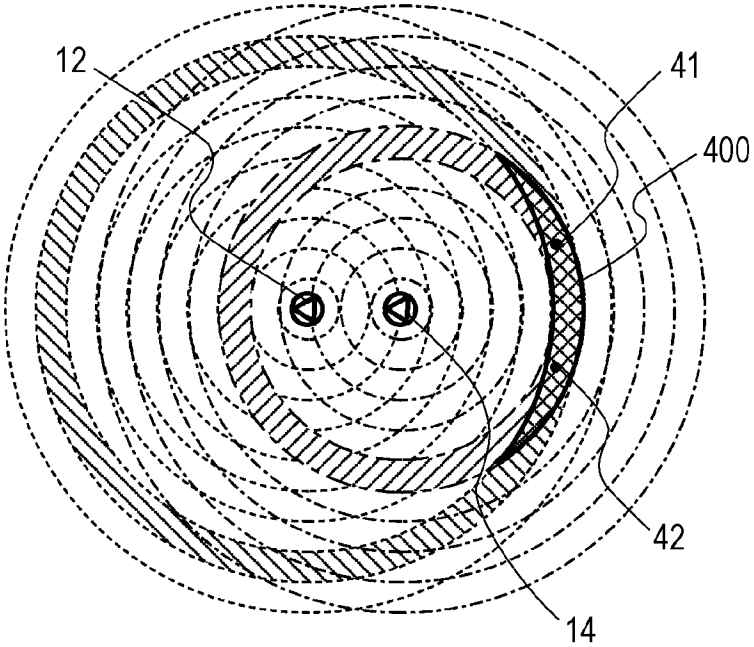

FIG. 4A is a two-dimensional schematic diagram when it is assumed that reference numeral 41 is a first cancellation point, reference numeral 42 is a second cancellation point, a region between adjacent circles of concentric circles having the first speaker 12 as the center is a range where the phase of the first cancellation signal CA1(*n*) is the same, and a region between adjacent circles of concentric circles having the second speaker 14 as the center is a range where the phase of the second cancellation signal CA2(*n*) is the same. A range where the phase of the first cancellation signal CA1(*n*) output from the first speaker 12 and the phase of the second cancellation signal CA2(*n*) output from the second speaker 14 are the same as those at the first cancellation point 41 and a range where the phase of the first cancellation signal CA1(*n*) output from the first speaker 12 and the phase of the second cancellation signal CA2(*n*) output from the second speaker 14 are the same as those at the second cancellation point 42 are all a range 400 surrounded by a solid line.

Therefore, within the range 400, in a range near the first cancellation point 41 where noise propagates in the same manner as at the first cancellation point 41, the same noise cancellation effect as at the first cancellation point 41 can be obtained. In addition, within the range 400, in a range near the second cancellation point 42 where noise propagates in the same manner as at the second cancellation point 42, the same noise cancellation effect as at the second cancellation point 42 can be obtained.

On the other hand, when the first speaker 12 is located in front of the right ear of the user sitting in the noise cancellation target seat, which is the first cancellation point, and the second speaker 14 is located in front of the left ear of the user sitting in the noise cancellation target seat, which is the second cancellation point, so that the first speaker 12 and the second speaker 14 are arranged side by side in the right-left direction of the vehicle, as illustrated in FIG. 4B, the range where the phase of the first cancellation signal CA1(*n*) output from the first speaker 12 and the phase of the second cancellation signal CA2(*n*) output from the second speaker 14 are the same as those at the first cancellation point 41 is a range 411 surrounded by the solid line, and the range where the phase of the first cancellation signal CA1(*n*) output from the first speaker 12 and the phase of the second cancellation signal CA2(*n*) output from the second speaker 14 are the same as those at the second cancellation point 42 is a range 412 surrounded by the solid line. Both the ranges 411 and 412 are narrower than the range 400 when the first speaker 12 and the second speaker 14 are arranged as illustrated in FIG. 4A.

Therefore, in the present embodiment, the first speaker 12 and the second speaker 14 are arranged side by side in a direction perpendicular to the line segment connecting the first cancellation point and the second cancellation point to each other such that the positions of the first speaker 12 and the second speaker 14 in the line segment direction are the same as the midpoint of the first cancellation point and the second cancellation point. As a result, it is possible to cancel the noise heard by the user without being easily affected by the displacement of the user.

In addition, the distance between the first speaker 12 and the second speaker 14 and the first cancellation point 41 and the second cancellation point 42 in the front-rear direction of the vehicle in FIG. 4B is the average of the distances between the first speaker 12 and the second speaker 14 and the first cancellation point 41 and the second cancellation point 42 in the front-rear direction of the vehicle in FIG. 4A.

In the above embodiment, the positions of the first speaker 12 and the second speaker 14 in the direction of the line segment connecting the first cancellation point and the second cancellation point to each other do not have to be exactly the same as the midpoint of the first cancellation point and the second cancellation point, and the positions of the first speaker 12 and the second speaker 14 in the line segment direction may be any positions between the first cancellation point and the second cancellation point. Even in this case, some effect can be expected.

Figure 5A:
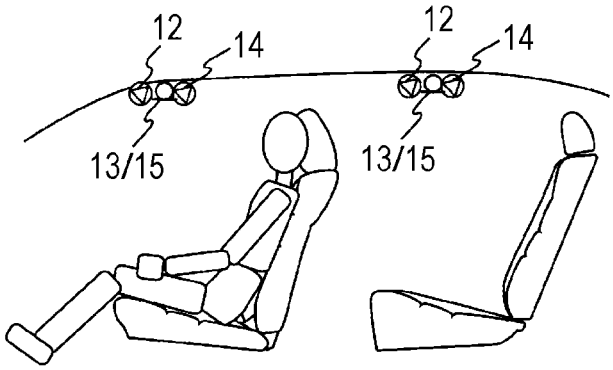
FIGS. 5A and 5B are diagrams illustrating another configuration example of the active noise control system according to the embodiment of the present invention.
Figure 5B:
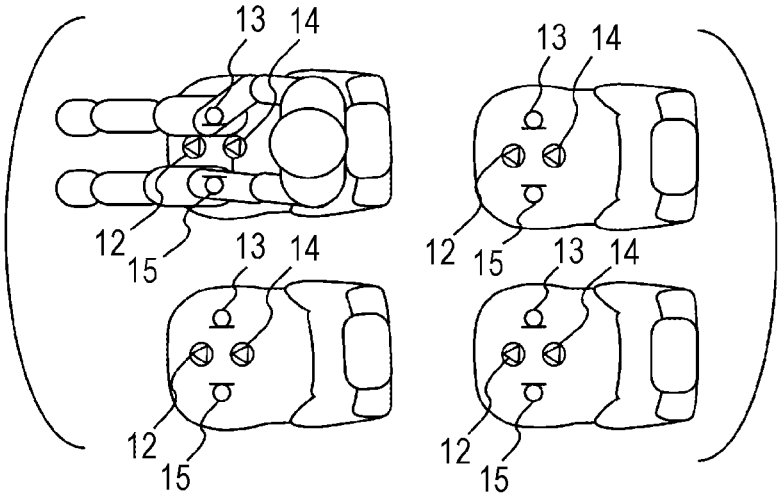

In the above embodiment, a case where the noise cancellation is performed for the user in one seat of the vehicle has been described. However, as illustrated in FIGS. 5A and 5B, the first speaker 12, the first microphone 13, the second speaker 14, and the second microphone 15 may be provided for each seat of the vehicle to cancel the noise for the user in each seat.

In addition, in the above embodiment, the noise signal x(n) input to the active noise control system 1 may be an audio signal output from the noise source 2, a voice signal picked up by a noise microphone provided separately, or a signal generated by a simulation sound generator, which is provided separately, to simulate the noise of the noise source. That is, for example, when the noise source 2 is an engine, the noise signal x(n) may be an engine sound picked up by a separate noise microphone or may be a simulation sound generated by a simulation sound generator, which is provided separately, to simulate the engine sound.

In addition, in the above embodiment, the signal processing block 11 may perform any signal processing different from that illustrated above as long as the first cancellation signal CA1(*n*) is generated and output from the first speaker 12 and the second cancellation signal CA2(*n*) is generated and output from the second speaker 14 so that the noise is canceled at both the first cancellation point and the second cancellation point.

The case where the noise cancellation is performed for the user in the seat of the vehicle has been described. However, this can be similarly applied to the case of canceling noise at any two cancellation points including a case where the noise cancellation is performed for both ears of the user in any seat of the vehicle.

In addition, a case where there is only one noise source has been described. However, the above embodiment can also be applied to a case where there is a plurality of noise sources by extending the configuration of the signal processing block 11 so as to consider the propagation of noise from each noise source to each cancellation point.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An active noise control system for reducing noise, comprising:

a first speaker configured to output a first cancellation sound;

a second speaker configured to output a second cancellation sound; and a cancellation sound generation unit that generates the first cancellation sound output from the first speaker and the second cancellation sound output from the second speaker such that noise is canceled at a first cancellation point set in advance and noise is canceled at a second cancellation point set in advance, wherein the first speaker and the second speaker are arranged side by side on a line extending in a direction perpendicular to a line segment connecting the first cancellation point and the second cancellation point to each other such that positions of the first speaker and the second speaker in a direction of the line segment are located between the first cancellation point and the second cancellation point, and the positions of the first speaker and the second speaker are on one side of the line segment.

2. The active noise control system according to claim 1, wherein the first speaker and the second speaker are arranged side by side in the direction perpendicular to the line segment connecting the first cancellation point and the second cancellation point to each other such that the positions of the first speaker and the second speaker in the direction of the line segment are the same as a midpoint of the first cancellation point and the second cancellation point.

3. The active noise control system according to claim 2, wherein the first cancellation point and the second cancellation point are a point where a left ear of a person sitting in a predetermined seat is normally located and a point where a right ear of a user is normally located, respectively.

4. The active noise control system according to claim 3, wherein the predetermined seat is a seat of a vehicle, and wherein the first speaker and the second speaker are arranged side by side in a front-rear direction of the vehicle on a ceiling in front of the seat of the vehicle.

5. The active noise control system according to claim 4, wherein the cancellation sound generation unit includes a first microphone, a second microphone, a first adaptive filter configured to receive a noise signal indicating the noise and generate the first cancellation sound, and a second adaptive filter configured to receive a noise signal indicating the noise and generate the second cancellation sound, and wherein the first adaptive filter and the second adaptive filter adapt their own transfer functions as the first cancellation sound output from the first speaker and the second cancellation sound output from the second speaker, using an input sound from each of the first microphone and the second microphone, so that noise is canceled at the first cancellation point and noise is canceled at the second cancellation point.

6. The active noise control system according to claim 5, wherein the cancellation sound generation unit includes a first auxiliary filter and a second auxiliary filter, the first adaptive filter and the second adaptive filter update their own transfer functions using a predetermined adaptive algorithm with a difference between the input sound from the first microphone and an output of the first auxiliary filter and a difference between the input sound from the second microphone and an output of the second auxiliary filter as errors, and, when a transfer function in which noise is canceled at the first cancellation point and the second cancellation point is set in the first adaptive filter and the second adaptive filter, a transfer function learned as a transfer function that eliminates the difference between the input sound from the first microphone and the output of the first auxiliary filter and the difference between the input sound from the second microphone and the output of the second auxiliary filter is set in the first auxiliary filter and the second auxiliary filter.

7. The active noise control system according to claim 1, wherein the first cancellation point and the second cancellation point are a point where a left ear of a person sitting in a predetermined seat is normally located and a point where a right ear of a user is normally located, respectively.

8. The active noise control system according to claim 7, wherein the predetermined seat is a seat of a vehicle, and wherein the first speaker and the second speaker are arranged side by side in a front-rear direction of the vehicle on a ceiling in front of the seat of the vehicle.

9. The active noise control system according to claim 8, wherein the cancellation sound generation unit includes a first microphone, a second microphone, a first adaptive filter configured to receive a noise signal indicating the noise and generate the first cancellation sound, and a second adaptive filter configured to receive a noise signal indicating the noise and generate the second cancellation sound, and wherein the first adaptive filter and the second adaptive filter adapt their own transfer functions as the first cancellation sound output from the first speaker and the second cancellation sound output from the second speaker, using an input sound from each of the first microphone and the second microphone, so that noise is canceled at the first cancellation point and noise is canceled at the second cancellation point.

10. The active noise control system according to claim 9, wherein the cancellation sound generation unit includes a first auxiliary filter and a second auxiliary filter, the first adaptive filter and the second adaptive filter update their own transfer functions using a predetermined adaptive algorithm with a difference between the input sound from the first microphone and an output of the first auxiliary filter and a difference between the input sound from the second microphone and an output of the second auxiliary filter as errors, and, when a transfer function in which noise is canceled at the first cancellation point and the second cancellation point is set in the first adaptive filter and the second adaptive filter, a transfer function learned as a transfer function that eliminates the difference between the input sound from the first microphone and the output of the first auxiliary filter and the difference between the input sound from the second microphone and the output of the second auxiliary filter is set in the first auxiliary filter and the second auxiliary filter.

11. The active noise control system according to claim 1, wherein the cancellation sound generation unit includes a first microphone, a second microphone, a first adaptive filter configured to receive a noise signal indicating the noise and generate the first cancellation sound, and a second adaptive filter configured to receive a noise signal indicating the noise and generate the second cancellation sound, and wherein the first adaptive filter and the second adaptive filter adapt their own transfer functions as the first cancellation sound output from the first speaker and the second cancellation sound output from the second speaker, using an input sound from each of the first microphone and the second microphone, so that noise is canceled at the first cancellation point and noise is canceled at the second cancellation point.

12. The active noise control system according to claim 11, wherein the cancellation sound generation unit includes a first auxiliary filter and a second auxiliary filter, the first adaptive filter and the second adaptive filter update their own transfer functions using a predetermined adaptive algorithm with a difference between the input sound from the first microphone and an output of the first auxiliary filter and a difference between the input sound from the second microphone and an output of the second auxiliary filter as errors, and, when a transfer function in which noise is canceled at the first cancellation point and the second cancellation point is set in the first adaptive filter and the second adaptive filter, a transfer function learned as a transfer function that eliminates the difference between the input sound from the first microphone and the output of the first auxiliary filter and the difference between the input sound from the second microphone and the output of the second auxiliary filter is set in the first auxiliary filter and the second auxiliary filter.

13. The active noise control system according to claim 3, wherein the cancellation sound generation unit includes a first microphone, a second microphone, a first adaptive filter configured to receive a noise signal indicating the noise and generate the first cancellation sound, and a second adaptive filter configured to receive a noise signal indicating the noise and generate the second cancellation sound, and wherein the first adaptive filter and the second adaptive filter adapt their own transfer functions as the first cancellation sound output from the first speaker and the second cancellation sound output from the second speaker, using an input sound from each of the first microphone and the second microphone, so that noise is canceled at the first cancellation point and noise is canceled at the second cancellation point.

14. The active noise control system according to claim 13, wherein the cancellation sound generation unit includes a first auxiliary filter and a second auxiliary filter, the first adaptive filter and the second adaptive filter update their own transfer functions using a predetermined adaptive algorithm with a difference between the input sound from the first microphone and an output of the first auxiliary filter and a difference between the input sound from the second microphone and an output of the second auxiliary filter as errors, and, when a transfer function in which noise is canceled at the first cancellation point and the second cancellation point is set in the first adaptive filter and the second adaptive filter, a transfer function learned as a transfer function that eliminates the difference between the input sound from the first microphone and the output of the first auxiliary filter and the difference between the input sound from the second microphone and the output of the second auxiliary filter is set in the first auxiliary filter and the second auxiliary filter.

* * * * *